US010076166B2

(12) United States Patent
Kim

(10) Patent No.: US 10,076,166 B2
(45) Date of Patent: Sep. 18, 2018

(54) SYSTEM FOR SECURING LUGGAGE

(71) Applicant: Soon Young Kim, New York, NY (US)

(72) Inventor: Soon Young Kim, New York, NY (US)

( * ) Notice: Subject to any disclaimer, the term of this patent is extended or adjusted under 35 U.S.C. 154(b) by 0 days.

(21) Appl. No.: 15/180,768

(22) Filed: Jun. 13, 2016

(65) Prior Publication Data

US 2017/0354218 A1 Dec. 14, 2017

(51) Int. Cl.

| | |
|---|---|
| ***A45C 13/38*** | (2006.01) |
| ***A45C 7/00*** | (2006.01) |
| ***A45C 5/14*** | (2006.01) |
| ***B65D 21/02*** | (2006.01) |
| ***A45C 13/26*** | (2006.01) |
| ***A45C 5/03*** | (2006.01) |

(52) U.S. Cl.
CPC ..... *A45C 7/0045* (2013.01); *A45C 5/03* (2013.01); *A45C 5/14* (2013.01); *A45C 13/262* (2013.01); *B65D 21/0201* (2013.01)

(58) Field of Classification Search
CPC ..... A45C 7/0045; A45C 13/38; A45C 13/385
USPC ..... 190/108, 102, 15.1
See application file for complete search history.

(56) References Cited

U.S. PATENT DOCUMENTS

| | | | | |
|---|---|---|---|---|
| 1,084,360 | A * | 1/1914 | Rahm | A45C 7/0045 190/108 |
| 4,122,925 | A | 10/1978 | Schultheiss | |
| 4,142,563 | A * | 3/1979 | Ackerfeldt | A63B 55/00 206/315.5 |
| D267,677 | S * | 1/1983 | Pelavin | 190/102 |
| 4,673,070 | A | 6/1987 | Ambal | |
| 4,836,343 | A | 6/1989 | Amey | |
| 5,099,968 | A | 3/1992 | Kikuchi | |
| 5,526,842 | A | 6/1996 | Christensen | |
| 5,628,443 | A * | 5/1997 | Deutsch | A45C 7/0086 150/113 |
| 5,713,439 | A * | 2/1998 | Zionts | A45C 5/14 150/108 |
| 6,073,737 | A | 6/2000 | Kang | |
| 6,213,266 | B1 | 4/2001 | Hollingsworth | |
| 6,478,151 | B1 * | 11/2002 | Schmidt | A45C 7/0086 190/108 |
| 7,526,842 | B2 * | 5/2009 | Wemmer | A41D 27/20 24/3.7 |

(Continued)

FOREIGN PATENT DOCUMENTS

| | | | | |
|---|---|---|---|---|
| DE | 3636064 | A1 * | 4/1988 | A45C 5/14 |
| DE | 102010026387 | A1 | 1/2012 | |

OTHER PUBLICATIONS

Thule Carry-On—Thule Crossover Rolling Carry-On Suitcase and Backpack with Laptop Sleeve, Retrieved from: https://www.etrailer.com/cargo-bags/thule/thtcru-115bgd.html om Mar. 1, 2016, 14pages.

*Primary Examiner* — Sue A Weaver
(74) *Attorney, Agent, or Firm* — St. Onge Steward Johnston & Reens, LLC

(57) ABSTRACT

A luggage system includes a first piece of luggage, a second piece of luggage, a first attachment member positioned on the first piece of luggage, and a second attachment member positioned on the second piece of luggage and adapted to couple to the first attachment member to secure the first and second pieces of luggage together, wherein the first and second attachment members are in a movable arrangement when coupled such that the first and second pieces of luggage move relative each other.

18 Claims, 16 Drawing Sheets

(56) References Cited

U.S. PATENT DOCUMENTS

| | | | | |
|---|---|---|---|---|
| 7,909,149 | B2 | 3/2011 | Marji | |
| 8,561,769 | B2 | 10/2013 | Andochick | |
| 8,936,140 | B2 * | 1/2015 | Herold | A45C 5/14 190/108 |
| 2006/0180624 | A1 * | 8/2006 | Sadow | A45C 7/009 224/582 |
| 2008/0011567 | A1 * | 1/2008 | Hammond | A45C 7/009 190/108 |
| 2008/0196988 | A1 * | 8/2008 | Tong | A45C 5/14 190/102 |
| 2008/0308369 | A1 | 12/2008 | Louis | |
| 2009/0139814 | A1 | 6/2009 | Grossman et al. | |
| 2009/0294236 | A1 * | 12/2009 | Satterfield | A45C 13/00 190/102 |
| 2010/0059323 | A1 * | 3/2010 | Marji | A45C 7/0045 190/18 A |
| 2013/0333996 | A1 | 12/2013 | Selvi | |
| 2015/0014949 | A1 | 1/2015 | Dittman | |
| 2015/0114777 | A1 | 4/2015 | Edme et al. | |
| 2015/0136553 | A1 | 5/2015 | Den Boer et al. | |

* cited by examiner

SYSTEM FOR SECURING LUGGAGE

FIELD OF THE INVENTION

The invention relates to luggage transport systems and methods. In particular, the invention relates to a system and method for securing two or more pieces of luggage together such that they can be easily maneuvered with one hand and transported on an escalator.

BACKGROUND OF THE INVENTION

Many travelers carry more than one suitcase or piece of luggage through airports, trains, buses or hotels. Transporting more than one piece of luggage is often difficult, especially when the traveler has to use one of his or her hands to do other tasks, such as handle traveling tickets or hold a beverage cup. There are usually transport carts available for transporting multiple pieces of luggage, but the carts typically require a fee, are bulky, and are not always practical to use. Additionally, airports, hotels and bus terminals often have multiple levels, requiring the traveler to transport luggage on an escalator, which further complicates handling multiple piece of luggage at the same time.

A number of prior art systems have been developed for transporting multiple piece of luggage. However, while these known systems provide various ways of attaching pieces of luggage together for transport, they are often too cumbersome, heavy, difficult to assemble and/or expensive to manufacture, thus resulting in a higher cost for consumers. Additionally, the prior art luggage transport systems are not adapted for being transported on an escalator, requiring the traveler to balance the entire weight of multiple connected luggage pieces on one escalator step, which is challenging. Another difficulty with known luggage transport systems is placing them on and then taking them off an escalator. Travelers often operate the luggage system with only one hand and it is difficult to correctly place the luggage system on an escalator step and then support it there such that it does not topple over.

SUMMARY OF THE INVENTION

Accordingly, it is an objective of the present invention to provide a luggage system that provides a simple and effective way of transporting multiple luggage pieces that is easy to assemble and operate.

It is also an objective of the present invention to provide a system for transporting multiple pieces of luggage that is specifically adapted for being easily transported on an escalator.

It is further an objective of the present invention to provide a luggage system for transporting multiple pieces of luggage that can be moved easily with one hand.

In order to overcome the deficiencies of the prior art and to achieve at least some of the objects and advantages listed, the invention comprises a luggage system, comprising a first piece of luggage, a second piece of luggage, a first attachment member positioned on the first piece of luggage, and a second attachment member positioned on the second piece of luggage and adapted to couple to the first attachment member to secure the first and second pieces of luggage together, wherein the first and second attachment members are in a movable arrangement when coupled such that the first and second pieces of luggage move relative each other.

In some embodiments, one of the first and second attachment members comprises a plurality of rings and the other attachment member comprises one or more vertically positioned rods that slidably engage the plurality of rings such that the first and second pieces of luggage slide up and down with respect to each other.

In certain embodiments, one of the first and second attachment members comprises a plurality of protrusions and the other attachment member comprises one or more vertical channels that slidably engage the plurality of protrusions to allow the first and second pieces of luggage to slide up and down with respect to each other.

In some embodiments, the first attachment member comprises a plurality of connectors positioned on the first piece of luggage and the second attachment member comprises a plurality of connectors position on the second piece of luggage, and wherein the luggage system further comprises a rope threaded through the plurality of the connectors of the first and second attachment members to secure the first and second pieces of luggage together in a movable arrangement that allows the first and second pieces of luggage to slide up and down with respect to each other.

In certain embodiments, the first attachment member is positioned on a front wall of the first piece of luggage and the second attachment member is positioned on a rear wall of the second piece of luggage such that the first and second pieces of luggage are connected in a tandem arrangement. In other embodiments, the first attachment member is positioned on a side wall of the first piece of luggage and the second attachment member is positioned on a side wall of the second piece of luggage such that the first and second pieces of luggage are connected in a side by side arrangement.

In some cases, at least one of the first attachment member and the second attachment member comprises a stop member that prevents movement of the other attachment member past the stop member.

In certain embodiments, at least one of the first piece of luggage and the second piece comprises two or more wheels.

In some embodiments, at least one of the first piece of luggage and the second piece comprises a handle for transporting the luggage.

In certain embodiments, the second luggage piece further comprises a third attachment member and the system further comprises a third piece of luggage with a fourth attachment member positioned thereon and adapted to couple to the third attachment member, wherein the third and fourth attachment members are in a movable arrangement when coupled such that the second and third pieces of luggage move relative each other.

The invention also comprises a luggage system, including a first piece of luggage having a vertical axis, a second piece of luggage, a substantially rigid first attachment member coupled to the first piece of luggage, and a substantially rigid second attachment member coupled to the second piece of luggage and adapted to movably engage the first attachment member to secure the first and second pieces of luggage together, wherein the first and second attachment members are movable along the vertical axis of the first piece of luggage when engaged.

In some embodiments, one of the first and second attachment members comprises a plurality of female connectors, each having an aperture therein. In certain of these embodiments, each of the plurality of female connectors has a base part coupled to one of the first and second pieces of luggage and a connector part that has the aperture therein and is movably coupled to the base part. In additional embodiments, the other attachment member comprises one or more vertically positioned elongated male connectors coupled to one of the first and second pieces of luggage. In certain of those embodiments, the one or more elongated male connectors extend through the apertures and slidably engage the plurality of female connectors such that the first and second pieces of luggage slide up and down with respect to each other. In further embodiments, the one or more elongated male connectors are coupled to one of the first and second pieces of luggage at an attachment point adjacent their bottom ends such that the female connectors cannot slide past the attachment point.

In some embodiments, one of the first and second attachment members comprises one or more vertically extending channels having an opening on one side that is opposite a side that faces a wall of one of the first and second pieces of luggage, wherein the channel opening has an inner diameter. In certain of those embodiments, the other attachment member comprises a plurality of protrusions, each protrusion having a base part coupled to one of the first and second pieces of luggage and a connector part having an outer diameter that is larger than the inner diameter of the channel opening. In additional embodiments, the connector part of each of the plurality of protrusions is positioned in and slidably engages one of the vertically extending channels such that the first and second pieces of luggage slide up and down with respect to each other. In further embodiments, each of the vertically extending channels a top end and a bottom end, wherein the top end is open to allow for insertion of the connector part of each of the plurality of protrusions into the channel, and the bottom end is closed such that the protrusions cannot slide out of the channel.

In certain embodiments, the first attachment member comprises a plurality of female connectors positioned on the first piece of luggage and the second attachment member comprises a plurality of female connectors positioned on the second piece of luggage, wherein each of the plurality of female connectors of the first and second attachment members has an aperture therein. In some of these embodiments, the luggage system further includes an elongated male connector extended through the apertures of the plurality of female connectors of the first and second attachment members to secure the first and second pieces of luggage together in a movable arrangement that allows the first and second pieces of luggage to slide up and down with respect to each other.

In additional embodiments, the luggage system further includes at least one additional attachment member having a first end coupled to the first piece of luggage and a second end coupled to the second piece of luggage, wherein the at least one additional attachment member attaches the first piece of luggage to the second piece of luggage such that they are movable along the vertical axis of the first piece of luggage when attached. In certain of these embodiments, the additional attachment member is removably coupled to the first and second pieces of luggage.

Other objects of the invention and its particular features and advantages will become more apparent from consideration of the following drawings and accompanying detailed description.

DETAILED DESCRIPTION OF THE INVENTION

Figure 1A:
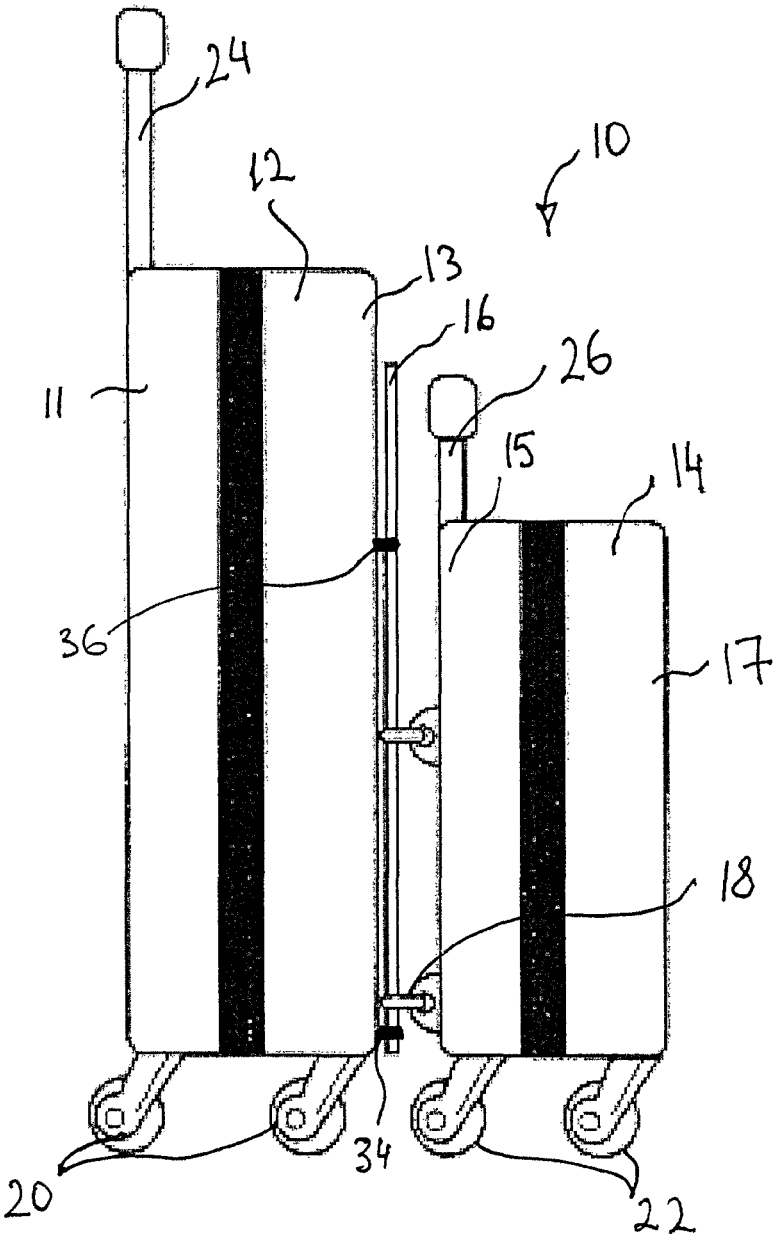
FIG. 1A is a side view of the luggage system in accordance with the present invention.

The basic components of an exemplary embodiment of a luggage system in accordance with the invention are illustrated in FIG. 1A. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The luggage system of the present invention is designed for attaching pieces of luggage to each other so that they can be moved easily with one hand. The present invention allows for one of the attached pieces of luggage to be elevated when riding on an escalator such that each piece of luggage rests on its own step. This distributes the weight of each piece of luggage across multiple steps, allowing a traveler to carry multiple pieces of luggage on an escalator without any hassle.

As illustrated in FIG. 1A, the luggage system 10 includes a first piece of luggage 12 and a second piece of luggage 14. Luggage pieces of any shape and/or size may be used with the present system. In some exemplary embodiments, the first luggage piece 12 is bigger in size than the second piece of luggage 14, although it is understood that both pieces may be the same size.

The first piece of luggage 12 has one or more sets of wheels 20 and the second piece of luggage has one or more sets of wheels 22 to facilitate transport of the luggage pieces by the user by rolling them on the ground surface. In other embodiments, only one of the luggage pieces has wheels and the other luggage piece, such as, e.g., a shoulder bag, a briefcase or a duffel bag, is attached to the first luggage piece such that its bottom does not touch the ground. One or both of the luggage pieces 12 and 14 also includes a handle 24 and 26 respectively that the user can grab to transport the luggage.

The luggage system 10 further includes a first attachment member 16 positioned on the first luggage piece and a second attachment member 18 positioned on the second luggage piece 14. The first and second attachment members 16, 18 are adapted to couple to each other to secure the first and second pieces of luggage 12, 14 together, as described in more detail below. The first and second attachment members 16, 18 are in a movable arrangement when coupled such that the first and second pieces of luggage 12, 14 move relative each other to allow the luggage system 10 to be easily transported on an escalator.

Figure 1D:
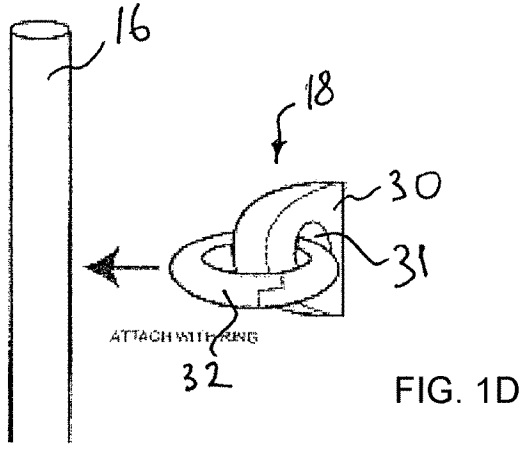
FIG. 1D is an enlarged view of a first attachment member and a second attachment member of the luggage system of FIG. 1A.
Figure 1C:
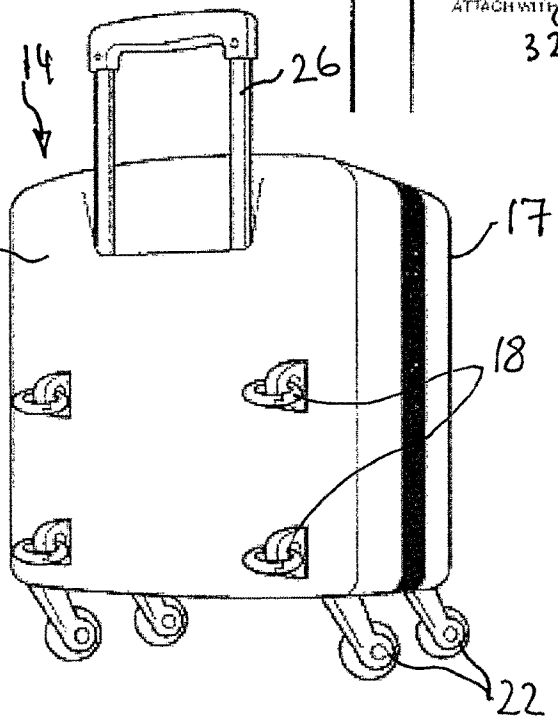
FIG. 1C is a rear perspective view of a second luggage piece of the luggage system of FIG. 1A.
Figure 1B:
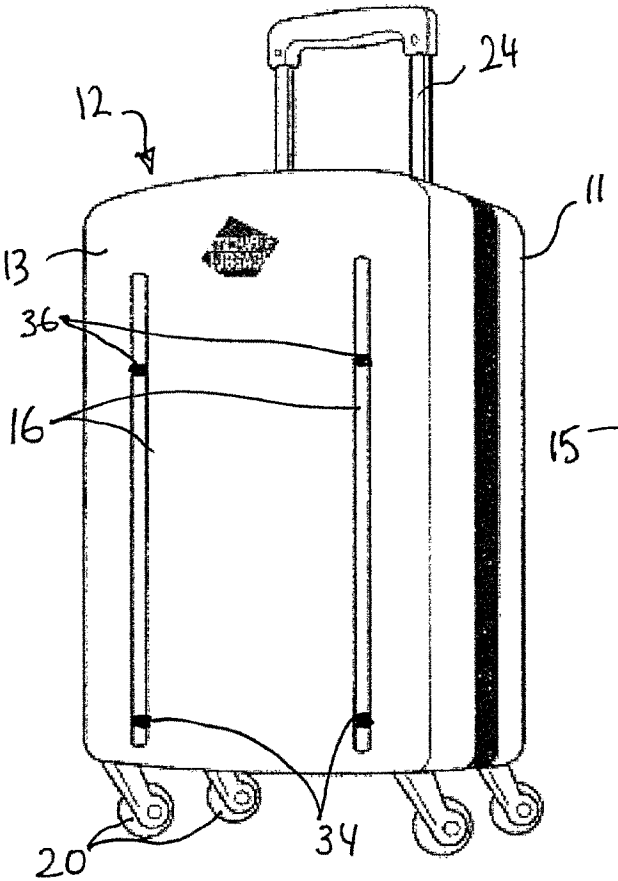
FIG. 1B is a front perspective view of a first luggage piece of the luggage system of FIG. 1A.

One exemplary embodiment of the attachment members 16, 18 is illustrated in FIGS. 1B-1D. As shown in FIG. 1B, the first piece of luggage 12 has two rod-like attachment members 16 positioned on its front wall 13 opposite its rear wall 11 that has the handle 24. The second piece of luggage 14 has two pairs of ring-like attachment members 18 positioned on its rear wall 15, which also has the handle 26, as illustrated in FIG. 10. Although FIGS. 1B and 10 illustrate FIG. 1D is an enlarged view of the first attachment member 16 and the second attachment member 18. The first attachment member 16 is rod-shaped and is made with any suitable material, such as, e.g. metal or hard plastic. The first attachment member 16 is secured to the first luggage piece by any suitable means, e.g., by gluing, sewing, molding, or stapling it to the wall of the luggage piece 12. It is noted that the first attachment member 16 can also be removably secured to the wall of the first luggage piece 12, e.g. by a snap-type or press-fit type connector. This allows for the luggage piece to be used as a standalone luggage and then to be easily adapted for use in the luggage system of the present invention.

The second attachment member 18 has two parts. First part is a holder piece 30 that is secured to the wall of the second piece of luggage 14 by gluing, sewing, stapling, molding or otherwise securing it to the luggage. Or, as described above, it can be removably attached to the second piece of luggage 14 to allow the luggage to be used as a standalone luggage and as a part of the luggage system of the present invention. The holder piece 30 has a hole 31 that accommodates a second part of the attachment member 18, which is a ring 32. The ring 32 has an inner diameter large enough to allow the ring 32 to be slid over the rod 16 to secure the first and second pieces of luggage 12, 14 together, as shown in FIG. 1A. The ring 32 is made with any suitable material, e.g., metal or plastic.

In order to secure the two pieces of luggage together, the ring-like second attachment members 18 of the second piece of luggage 14 are slid over the rod-like first attachment members 16 of the first piece of luggage 12. The second luggage piece 14 is then lowered until it reaches a desired position with respect to the first luggage piece 12. If both the first and second luggage pieces 12, 14 are designed to be wheeled on the ground, the second luggage piece 14 is lowered until its bottom is lined up with the bottom of the first piece 12, such that both pieces can be wheeled on the ground as a unit. If the second piece of luggage 14 does not have wheels, it may be desirable to position it with its bottom elevated with respect to the bottom of the first piece 12 such that the first luggage piece can be wheeled on the ground with the second luggage piece attached to it.

In some embodiments, instead of being slid over the rod-like first attachment members 16, the ring-like second attachment members 18 are clipped onto the rods 16. The rings 18 may have a movable part that can be pivoted to provide an opening in the ring circumference to allow the rings 18 to be opened to insert the rods 16 inside the rings. Any type of movable mechanism can be used, such as, e.g., a carabiner-type mechanism.

The rods 16 are attached to the wall of the first piece of luggage 12 in at least one location 34 adjacent a bottom end of the rods, as shown in FIGS. 1A and 1B. This allows the rings 32 of the second attachment member 18 to slide freely along the rods 16 to attach the first and second pieces of luggage 12, 14 to each other and also to allow one of the luggage pieces to be elevated relative the other piece when transporting the luggage system on an escalator. The attachment point 34 further ensures that the rings 32 cannot slide down the rods 16 past the point 34 and become disengaged from the rods. It is noted, however, that the rods 16 may be attached to the first luggage piece 12 at a different location or in more than one location, as desired.

In some embodiments, as illustrated in FIGS. 1A and 1B, one or more stopper members 36 is removably positioned on the rods 16 at a location adjacent a top end of the rods 16. The stopper members 36 function to prevent the rings 32 from sliding upward along the rods 16 beyond the stopper members 32 to ensure that the rings 32 do not become disengaged from the rods 16 during the transport of the luggage system 10. The stopper members 36 are removed or opened during the steps of attaching and detaching the luggage pieces 12, 14 from each other, such that the rings 32 can slide on and off the rods 16 from their top ends. The stopper members 36 may be removably clipped onto the rods, may be attached to the first luggage piece 12 and have a part that opens and closes over the rods 16 or the rods may be press-fit into the stopper members that are attached to the luggage wall.

Figure 2A:
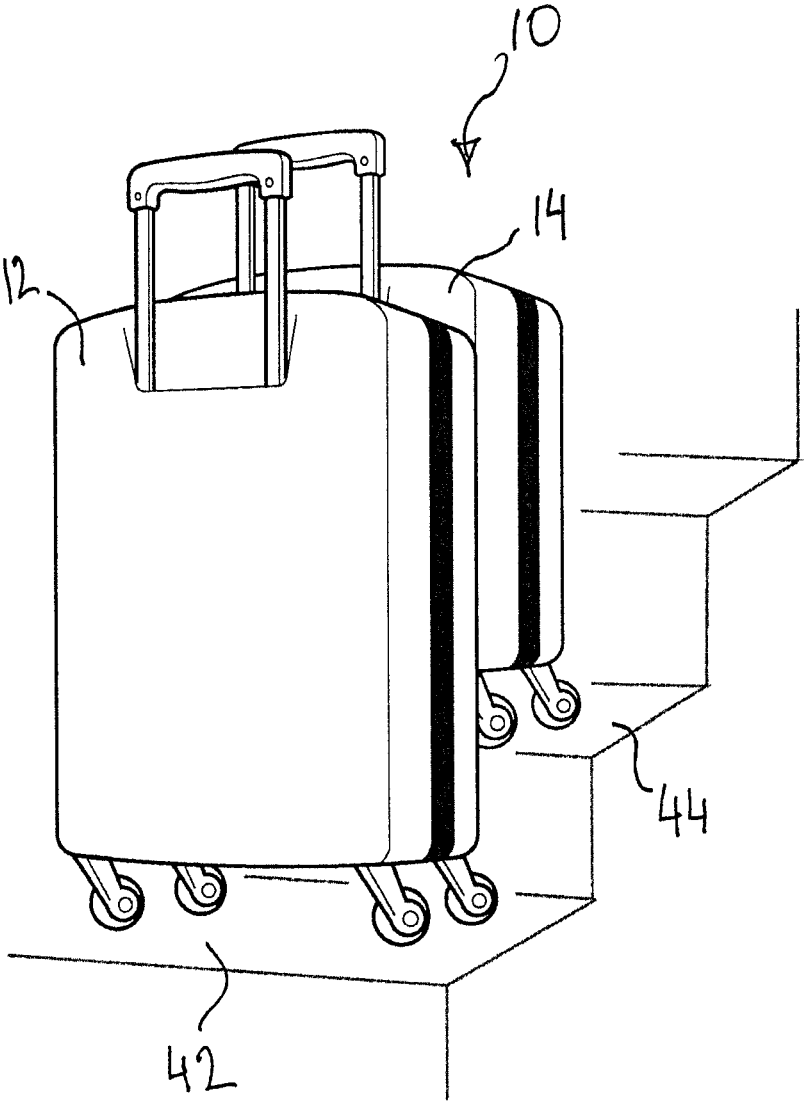
FIGS. 2A and 2B illustrate the luggage system of FIG. 1A being transported on an escalator.
Figure 2B:
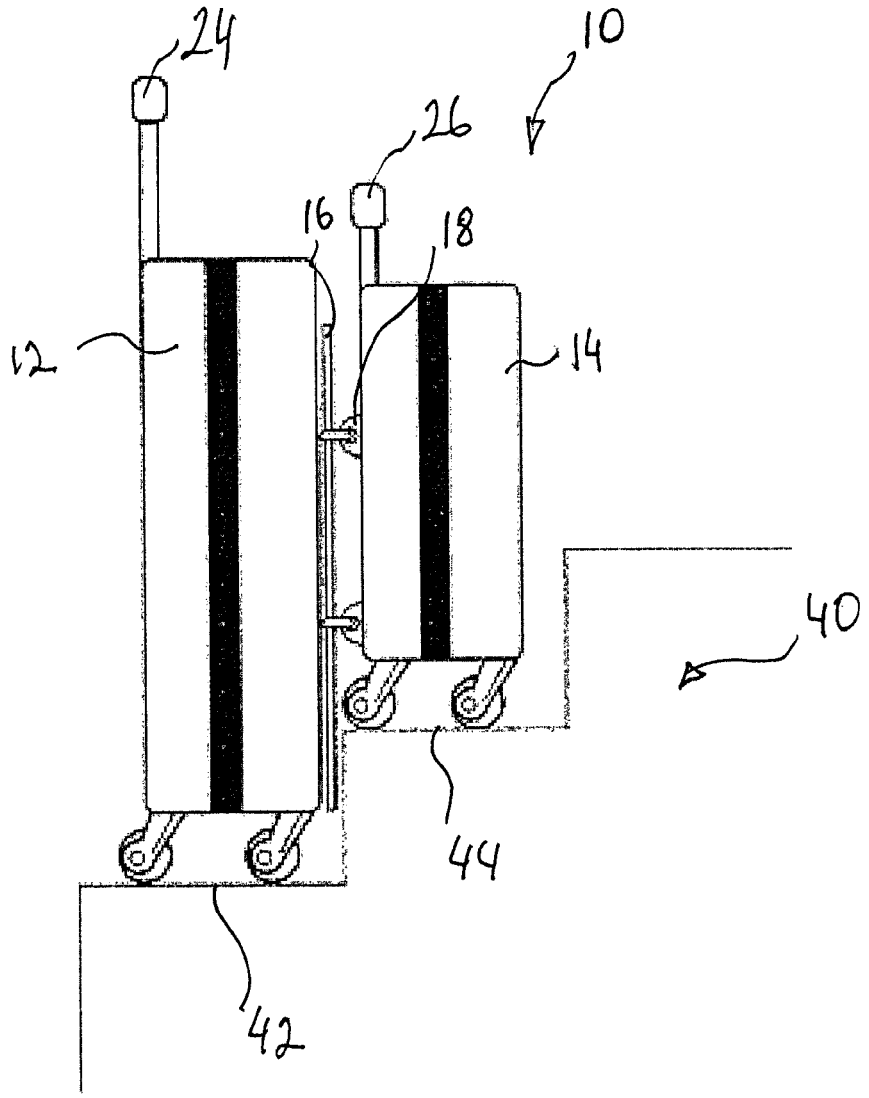

FIGS. 2A and 2B illustrate the method of transporting the luggage system 10 of the present invention on an escalator 40. The first piece of luggage 12 and the second piece of luggage 14 are in the attached configuration, wherein the first attachment member 16 is slidably engaged with the second attachment member 18. The first and second pieces of luggage 12, 14 are placed on the escalator 40, when it is flat, such that the first luggage piece 12 rests on one escalator step 42 and the second luggage piece rests on the next escalator step 44. As the escalator 40 begins to ascend, the second step 44 is elevated relative the first step 42. Consequently, the second piece of luggage 14 resting on the second step 44 is elevated relative the first piece of luggage 12 resting on the first step 42, while the first and second luggage pieces remain in the attached arrangement, as shown in FIG. 2B. This is made possible by means of the second attachment member 18, i.e. the plurality of rings, sliding upwardly along the first attachment member 16, i.e. vertically extending rod.

Once the luggage system 10 reaches a top of the escalator, the steps 42 and 44 become leveled again. The rings 18 slide down the rod 16, such that the bottoms of the first and second luggage pieces 12, 14 become leveled. The luggage system 10 can then be easily moved from the escalator to the ground by maneuvering it by one of the handles 24, 26. The luggage system of the present invention thus allows for one of the attached pieces of luggage to be elevated when riding on an escalator such that each piece of luggage rests on its own step. This distributes the weight of each piece of luggage across multiple steps, allowing a traveler to carry multiple pieces of luggage on an escalator without any hassle.

Figure 3:
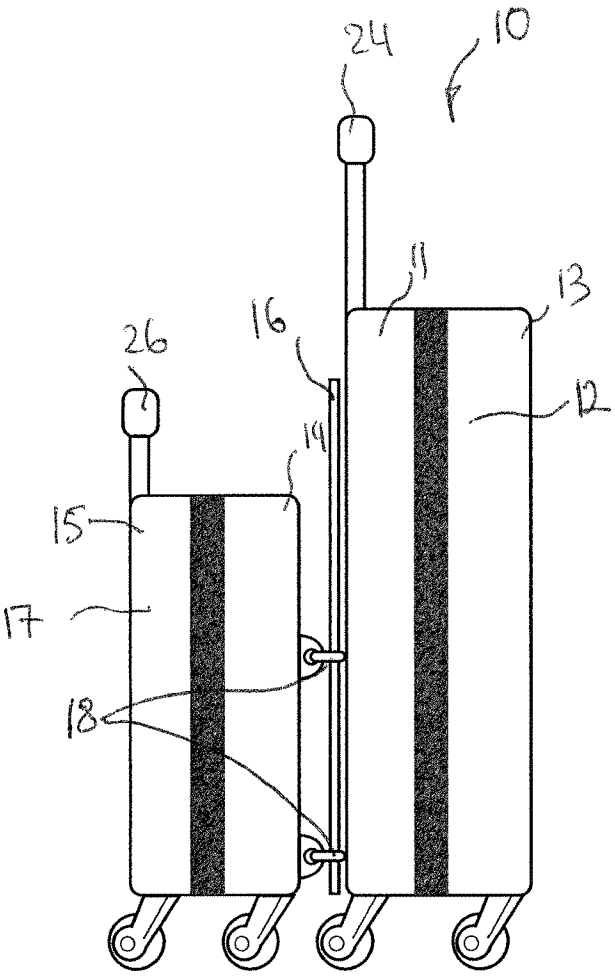
FIG. 3 is a side view of another embodiment of the luggage system in accordance with the present invention.

It is understood that the embodiment of the luggage system illustrated in FIGS. 1A-1D and 2A-2B is only exemplary, and that other embodiments are envisioned within the scope of the present invention. For example, as illustrated in FIG. 3, the first attachment member 16 may be coupled of the rear wall 11 of the first piece of luggage 12, instead of the front wall 13. Consequently, the second attachment member 18 is coupled to the front wall 17 of the second piece of luggage 14 instead of the rear wall 15. This way, when attached, the front of the second luggage piece 14 faces the rear of the first luggage piece 12. The first and second luggage pieces 12, 14 can also be attached face to face or rear to rear by positioning the first and second attachment members accordingly.

Figure 4A:
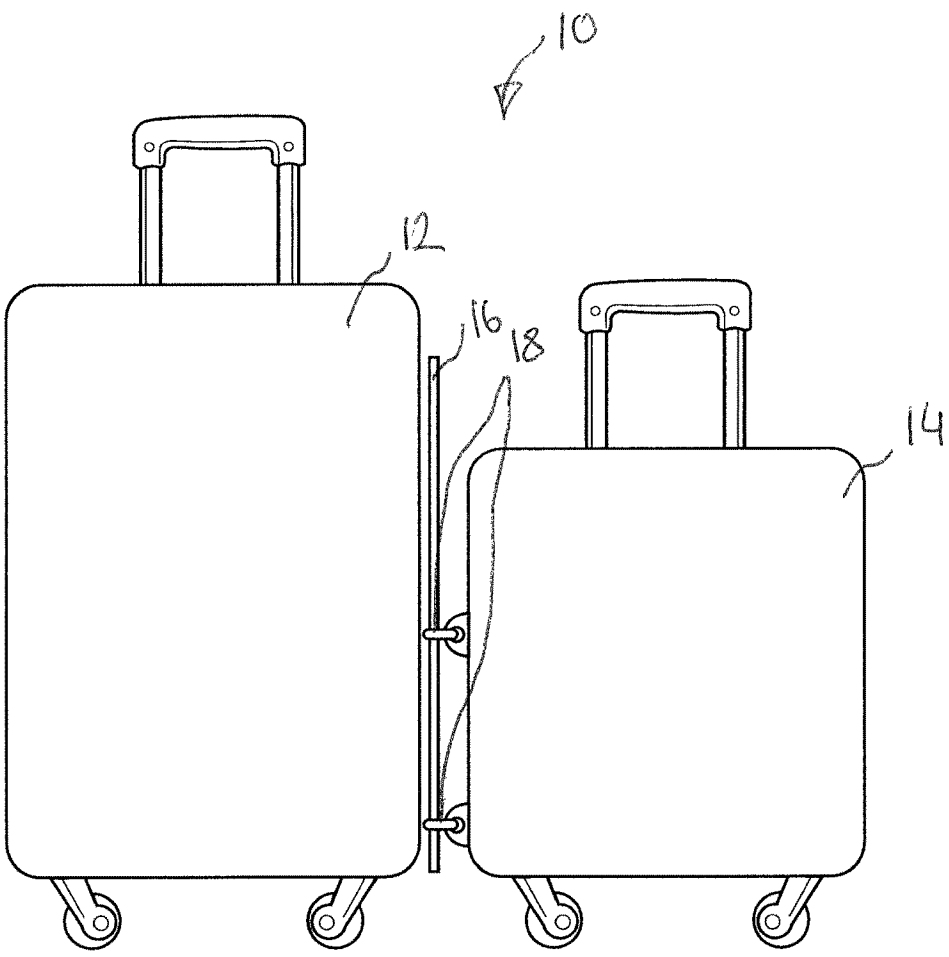
FIG. 4A is front view of an additional embodiment of the luggage system in accordance with the present invention.
Figure 4C:
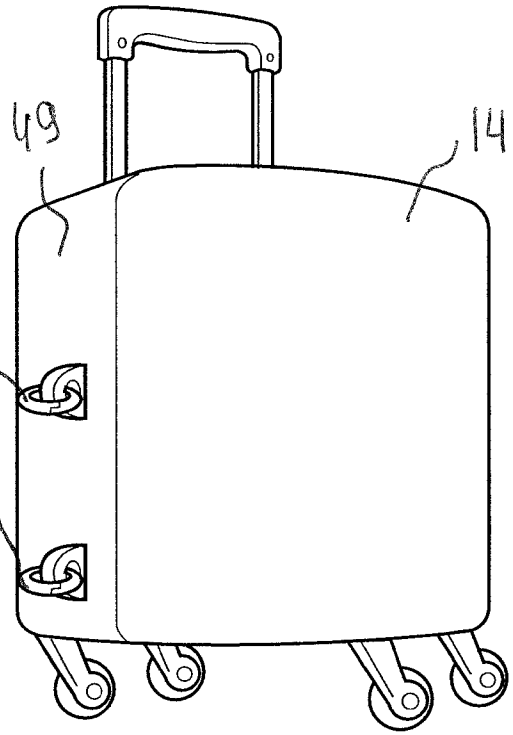
FIG. 4C is a front perspective view of a second luggage piece of the luggage system of FIG. 4A.
Figure 4B:
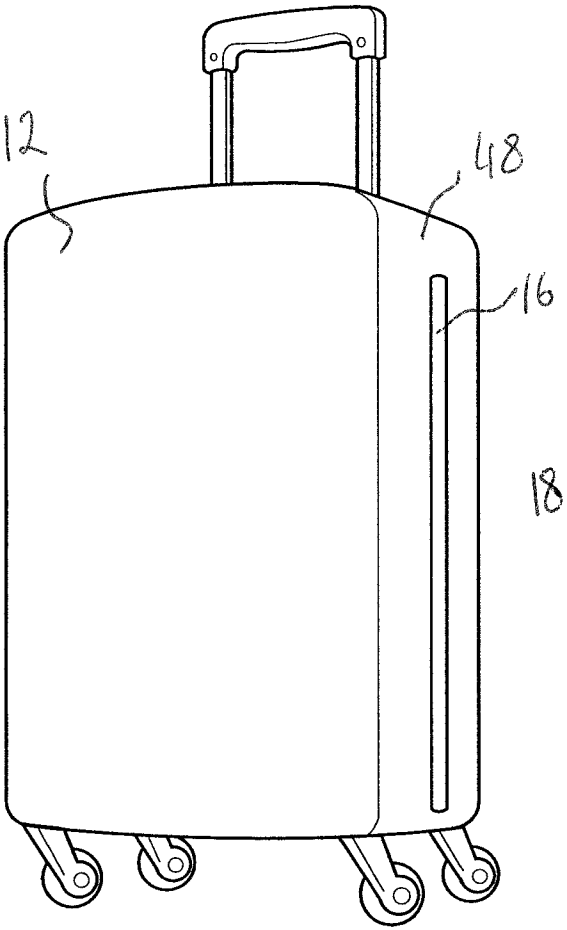
FIG. 4B is a front perspective view of a first luggage piece of the luggage system of FIG. 4A.
Figure 4D:
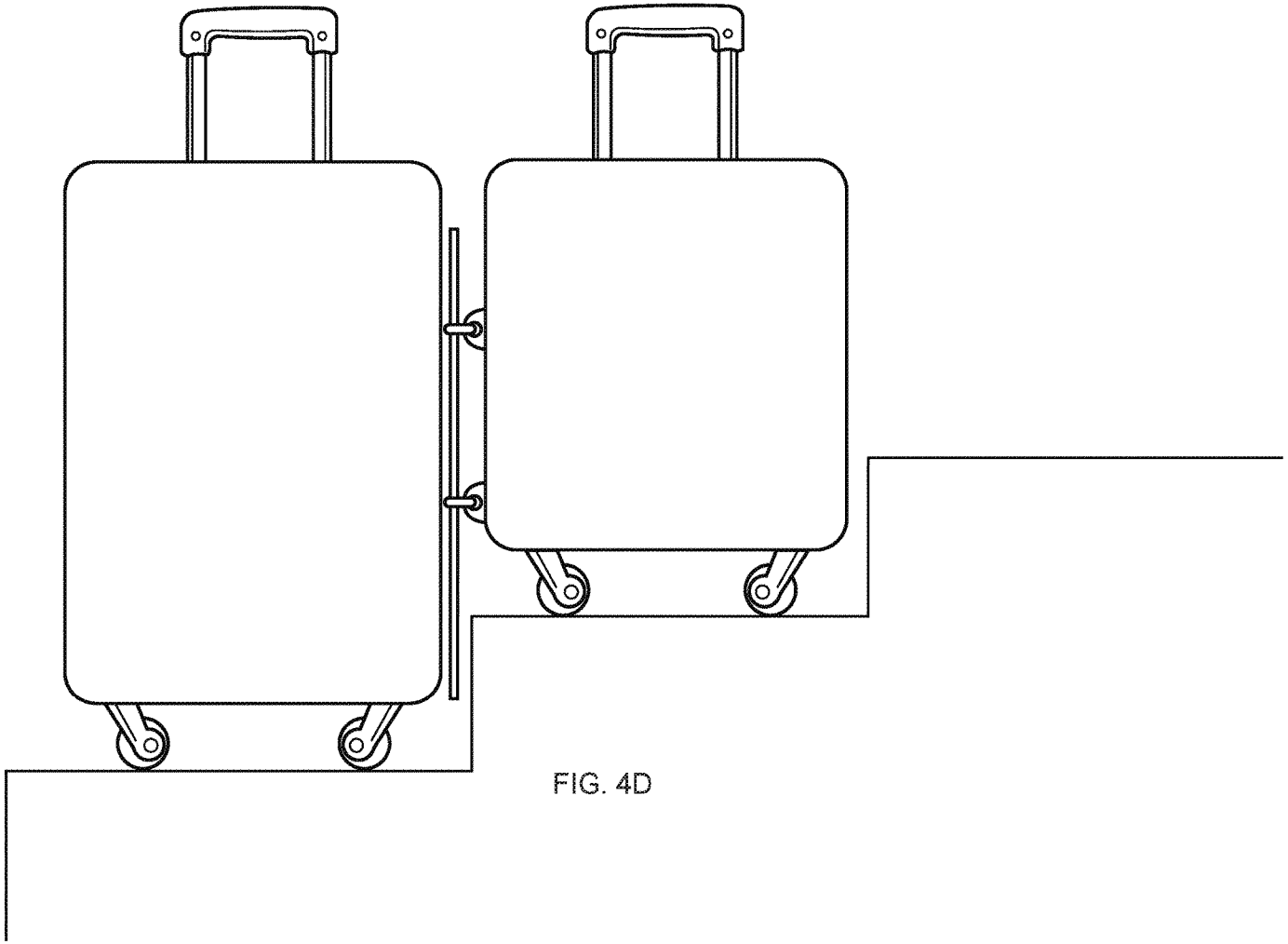
FIG. 4D illustrates the luggage system of FIGS. 4A-4C being transported on an escalator.

FIGS. 4A-4D illustrate another example of the luggage system configuration. In this embodiment, the first attachment member 16 is coupled to one of the side walls 48 of the first piece of luggage 12. Similarly, the second attachment member 18 is coupled to a corresponding side wall 49 of the second piece of luggage 14, as seen in FIGS. 4B and 4C. When the first and second luggage pieces 12, 14 are attached to each other by slidably engaging the first attachment member 16 with the second attachment member 18, they are transported in a side-by-side arrangement, as shown in FIGS. 4A and 4D, wherein the first piece of luggage 12 and the second piece of luggage 14 each rest on a separate escalator step when transported on an escalator while maintaining the engaged configuration.

An existing frame of a luggage piece may be utilized as an attachment member in the present luggage transport system to simplify the system construction, reduce cost and/or to allow existing standalone luggage to be easily converted into the transport system. As shown in FIGS. 5A-5G, a first luggage piece 110, a second luggage piece 112, and a third luggage piece 114 form the transport system 100. The luggage pieces 110, 112, 114 each have a handle 115, 118, 122 respectively for transporting the luggage. Handles 118 and 122 have an exposed frame 120 and 124 respectively, each formed by two vertical rods that extend from a bottom portion of a rear wall of the luggage pieces to the handle. The frames 120 and 124 are secured to the luggage pieces 112 114 respectively at their bottom end and also somewhere along the length of the frames. For example, holding members 117 and 119 may be provided on the luggage wall to secure the frames 120 and 124 to the luggage pieces 112 and 114. The holding members may be a strip of material used for the luggage itself that is secured to the luggage wall or any other suitable mechanism.

Figure 5A:
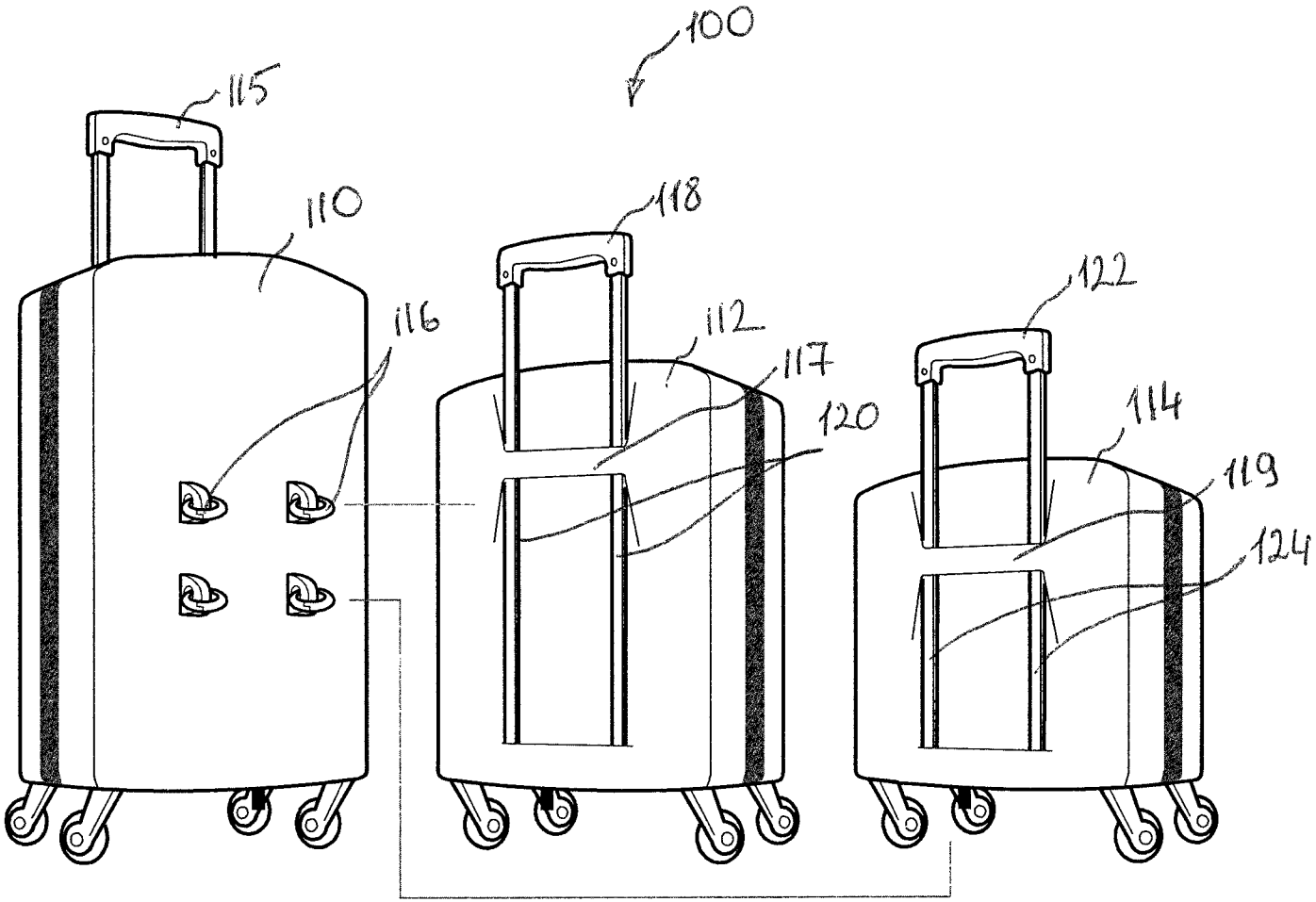
FIG. 5A is a perspective view of another embodiment of the luggage system of the present invention.

The first luggage piece 110 has a plurality of ring-like first attachment members 116 positioned on its front wall, as shown in FIG. 5A. Similarly, the second piece of luggage has a plurality of ring-like third attachment members 128 positioned on its front wall, as seen in FIG. 5B. The ring-like attachment members 116, 128 slidably engage the frames 120, 124 such that the luggage pieces are connected together for transport and also are capable of moving up and down relative each other when transported on an escalator. The rings engage the frame rods by, e.g., being clipped to the rods, as described in more detail above. The holding members 117 and 119 also function as stoppers to prevent the rings from moving past a certain point on the frames to prevent the luggage pieces from moving too far past each other.

Figure 5C:
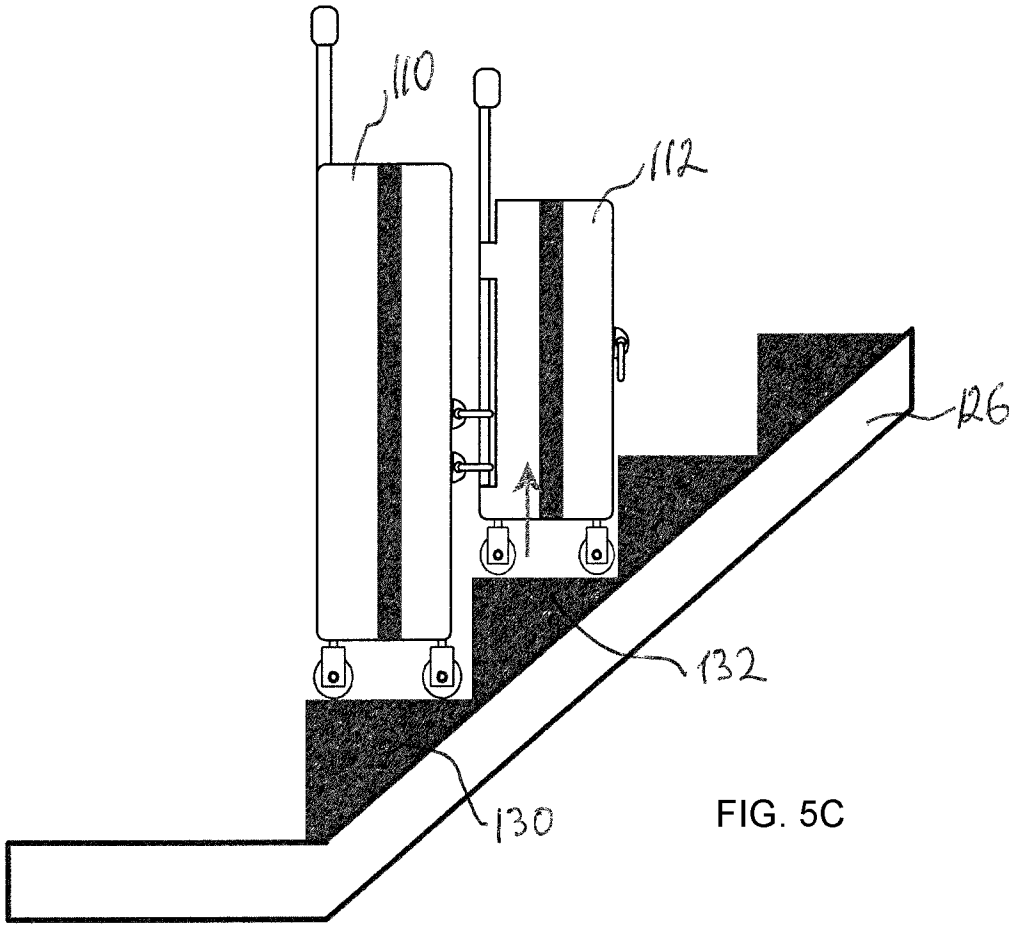
FIG. 5C is a side view of the luggage system of FIG. 5B, being transported on an escalator.
Figure 5B:
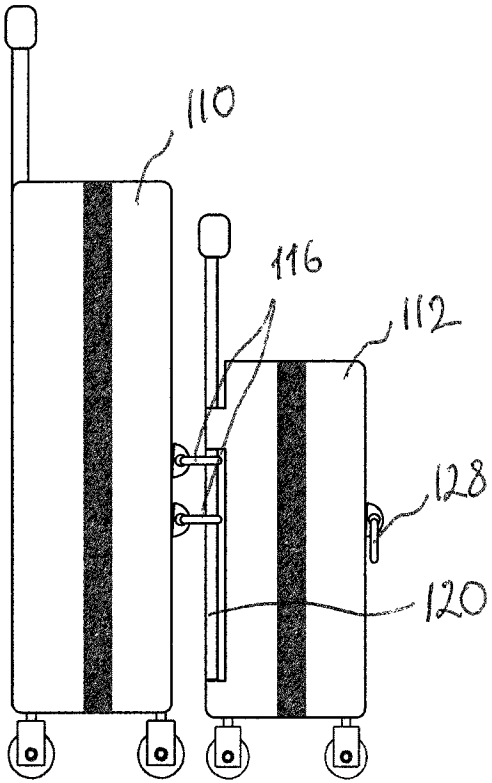
FIG. 5B is a side view of the luggage system of FIG. 5A, showing first and second luggage pieces attached.

FIGS. 5B and 5C illustrate the first piece of luggage 110 coupled to the second piece of luggage 112. The rings 116 positioned on the front wall of the first luggage piece 110 slidably engage the frame rods 120 positioned on the rear wall of the second luggage piece 112. Once the luggage pieces 110, 112 are positioned on an escalator 126, as shown in FIG. 5C, the first piece 110 rests on the first escalator step 130 and the second piece 112 rests on the second escalator step 132. As the escalator begins to ascend, the step 132 is elevated relative the step. The rings 116 slide down the rods 120 and the second piece of luggage 112 moves up relative the first piece 110 such that the system 100 is easily transported on the escalator. Once the escalator reaches the top, the steps 130 and 132 become leveled, which causes the rings 116 to slid up the rods 120, bringing the first and second luggage pieces 110, 112 in level with each other, such that they can be moved from the escalator and transported on the ground as a unit.

Figure 5E:
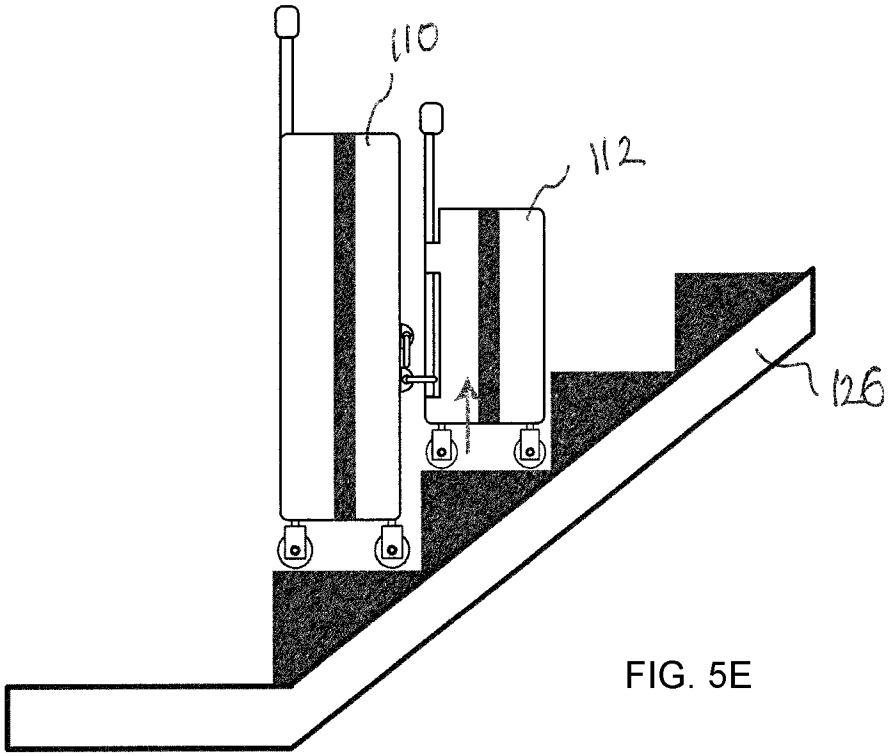
FIG. 5E is a side view of the luggage system of FIG. 5D, being transported on an escalator.
Figure 5D:
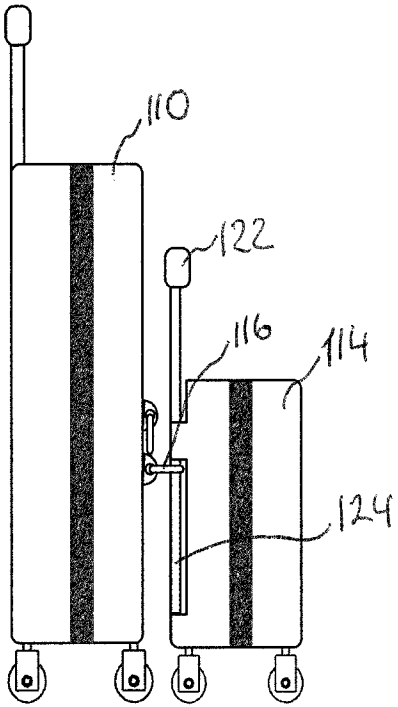
FIG. 5D is a side view of the luggage system of FIG. 5A, showing first and third luggage pieces attached.

In some cases, it may be desirable for the third piece of luggage 114 to be attached directly to the first piece of luggage 110, as shown in FIGS. 5D and 5E. In this case, the rings 116 of the first piece 110 slidably engage the rods 124 of the third piece 114. Because the third piece of luggage is smaller in size, only one set of the rings 116 is utilized to engage the rods 124. It is understood that the rods 124 may engage both sets of the rings 116. As the escalator steps are elevated relative each other, the third luggage piece 114 is elevated relative the first piece 110, as shown in FIG. 5E, by sliding the rings 116 down the rods 124.

Figure 5G:
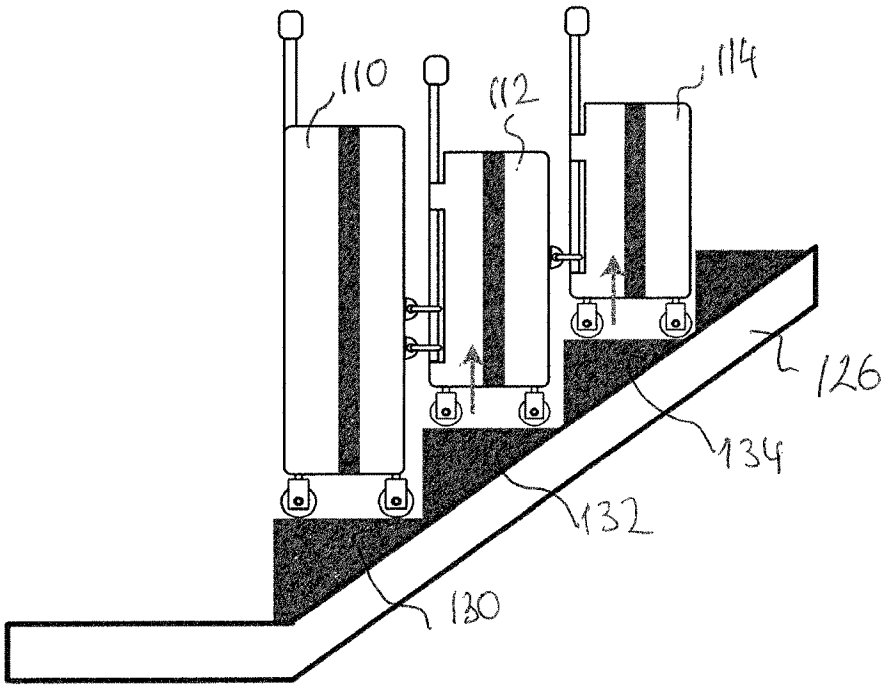
FIG. 5G is a side view of the luggage system of FIG. 5F, being transported on an escalator.
Figure 5F:
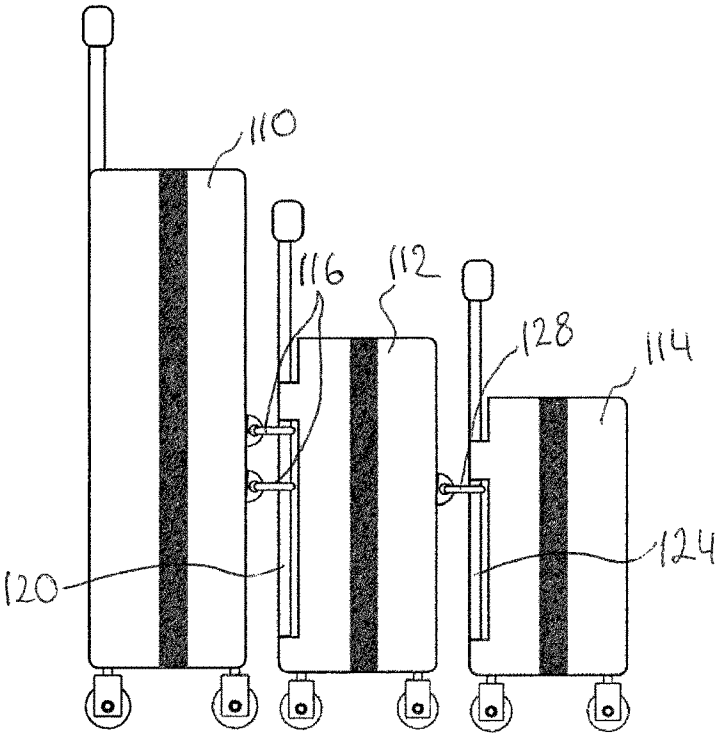
FIG. 5F is a side view of the luggage system of FIG. 5A, showing first, second, and third luggage pieces attached.

FIGS. 5F and 5G illustrate all three piece of luggage being connected together to form the transport system 100. The rings 116 of the first piece of luggage slidably engage the rods 120 of the second piece of luggage 112, and the rings 128 of the second piece 112 slidably engage the rods 124 of the third piece of luggage. Once the system 100 is placed on the escalator 126, each of the luggage pieces 110, 112, and 114 rests on its own escalator step 130, 132, and 134 respectively. As the escalator ascends, the second piece of luggage is elevated relative the first piece as the rings 116 slide down the rods 120, and the third piece of luggage is elevated relative the second piece as the rings 128 slide down the rods 124, as seen in FIG. 5G.

It is understood that the first luggage piece 110 may also have a handle frame that functions as an attachment member, as described above. Also, the third piece of luggage 114 may have one or more ring-like attachment members positioned on its front wall. The luggage pieces 110, 112 and 114 may be attached is a reverse tandem order, i.e. with front of the second and/or third luggage pieces 112, 114 being coupled to the frame on the rear wall of the first piece of luggage 110, similar to the embodiment illustrated in FIG. 3 above. It is also noted that the handle frames of the luggage pieces may be in a form of channels instead of rod-like members, as described in more detail below.

Figure 6A:
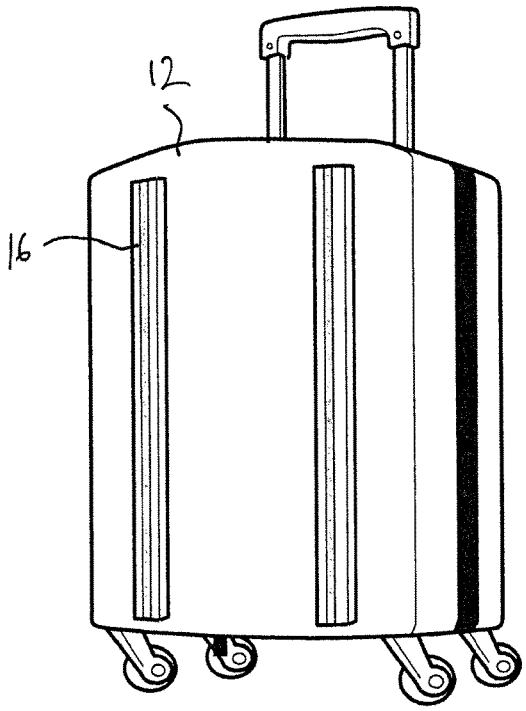
FIG. 6A is a front perspective view of a first luggage piece of another embodiment of the luggage system of the present invention.

Other types of attachment members may be used in the luggage system of the present invention. As shown in FIG. 6A, the first attachment member 16 is in a form of an elongated channel that extends along a vertical axis of the first piece of luggage 12. One or more elongated channels may be provided, as desirable. In the embodiment shown in this figure, two channels 16 extend adjacent each side of the luggage piece. The channels 16 are made with any suitable material, e.g. metal or plastic, and may have different dimensions and shapes. The channels 16 are permanently or removably coupled to a front wall of the first piece of luggage 12 by any suitable method, as described above with respect to FIGS. 1A-1D.

Figure 7A:
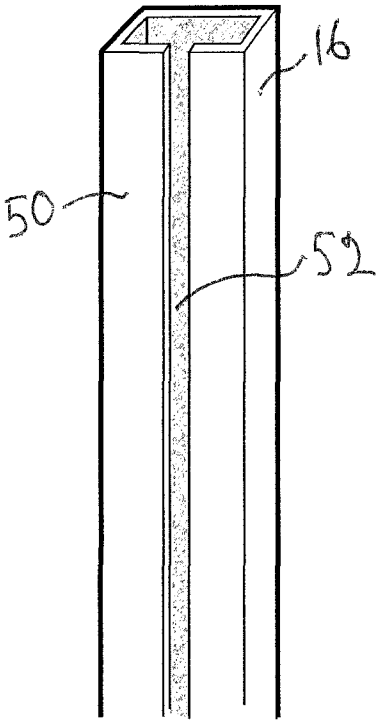
FIG. 7A is a partial enlarged view of a first attachment member of the luggage system of FIGS. 6A-6B.
Figure 7B:
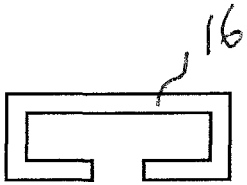
FIG. 7B is a top view of the first attachment member of FIG. 7A.

Each of the channels 16 is C-shaped with an elongated opening 52 that extends substantially along the entire length of the channel 16, as shown in FIGS. 7A and 7B. The opening 52 is provided on the channel side 50 that faces away from the wall of the first piece of luggage 12, as seen from FIG. 6A. It is understood, however, that the elongated channels may have a different shape.

Figure 6B:
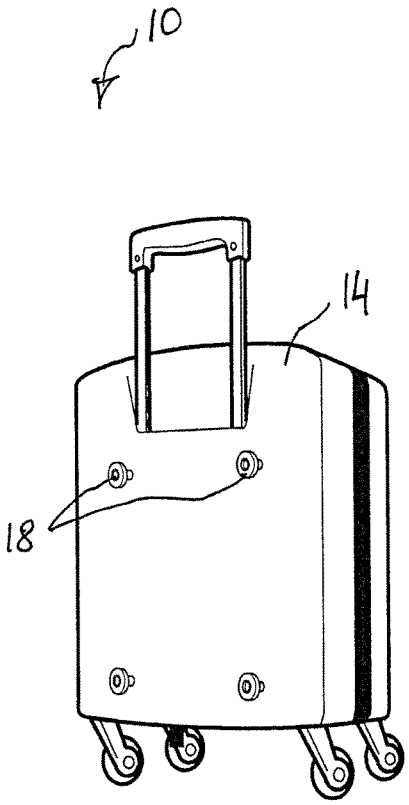
FIG. 6B is a front perspective view of a second luggage piece of the luggage system of FIG. 6A.

FIG. 6B illustrates the second attachment member 18, which comprises a plurality of protrusions coupled to a rear wall of the second luggage piece 14. In the exemplary embodiment shown in this figure, there are two pairs of protrusions 18, each pair corresponding to one of the elongated channels 16 of the first piece of luggage 12. It is noted that only one position or more than two protrusions may be provided for each elongated channel. The protrusions 18 are permanently or removably coupled to the wall of the second piece of luggage 14 by any suitable method described above.

Figure 7C:
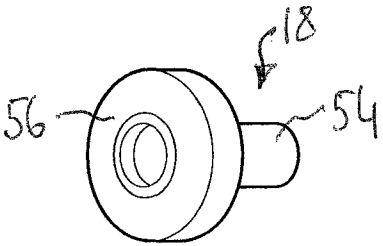
FIG. 7C is an enlarged front perspective view of a second attachment member of the luggage system of FIGS. 6A-6B.
Figure 7D:
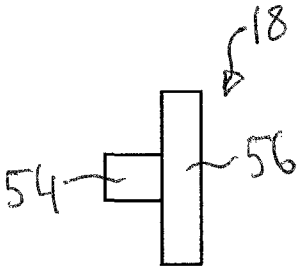
FIG. 7D is a side view of the second attachment member of FIG. 7C.
Figure 7E:
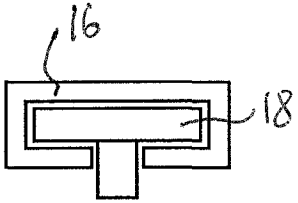
FIG. 7E is a partial enlarged view of the first and second attachment members of the luggage system of FIGS. 6A-6B, showing the second attachment member engaging the first attachment member.

As shown in FIGS. 7C and 7D, each protrusion 18 has a base part 54 and a connector part 56. The base part has an outer diameter that is smaller that the inner diameter of the opening 52 in the elongated channels 16 such that it freely slides along the opening. One end of the base part 54 is coupled to the wall of the second piece of luggage, as described above. The other end of the base part 54 abuts the connector part 56, which has an outer diameter that is larger than the diameter of the base part 54 and the inner diameter of the opening 52, but smaller than the inner diameter of the channel 16 such that it fits inside the channel, as illustrated in FIG. 7E. This way, the connector part 56 of each protrusion 18 is slidably engaged inside the channel 16 when the first and second pieces of luggage 12, 14 are in the attached configuration.

In order to attach the first and second pieces of luggage 12, 14 together, the connector parts 56 of the protrusions 18 are inserted into the channels 16 through an open top end of each channel 16. The protrusions are then slid down along the channels 16, such that the connector parts 56 remain inside the channels 16 and the base parts 54 slide inside the channel opening 52. In some embodiments, bottom ends of the channels 16 are closed off such that the protrusions 18 cannot slide past the bottom ends of the channels 16 and become disengaged from the channels. In other embodiments, the channels 16 may be provided with a stopper member adjacent their bottom ends to prevent the protrusions from sliding out of the channels.

Once the first and second luggage pieces 12, 14 are placed on separate escalator steps, as described above with respect to FIGS. 2A-2B, the protrusions 18 slide inside the channels 16 to allow one of the luggage pieces to be elevated with respect to the other luggage piece, while maintaining them in the attached arrangement. This allows for an easy transport of the luggage system 10 on an escalator, which the weigh of each luggage piece resting on a separate escalator step, without the need to balance the entire weight of the luggage system on a single escalator step. Once the luggage system reaches the top of the escalator, the protrusions 18 slide down inside the channels 16, such that the first and second pieces of luggage 12, 14 are brought back to their initial configuration for transport on a flat ground surface.

It is understood that the channels 16 may be provided on the rear wall of the first piece of luggage 12 with the corresponding protrusions 18 provided on the front wall of the second piece of luggage. Additionally, the channels 16 may be coupled to the second piece of luggage 14 and the protrusions may be coupled to the first piece of luggage 12. Furthermore, the channels 16 and the corresponding protrusions 18 may be provided on the side walls of the first and second pieces of luggage, instead of the front and rear walls, such that the two pieces of luggage are connected in a side-by-side arrangement instead of the tandem arrangement, as described in more detail above.

Figure 8A:
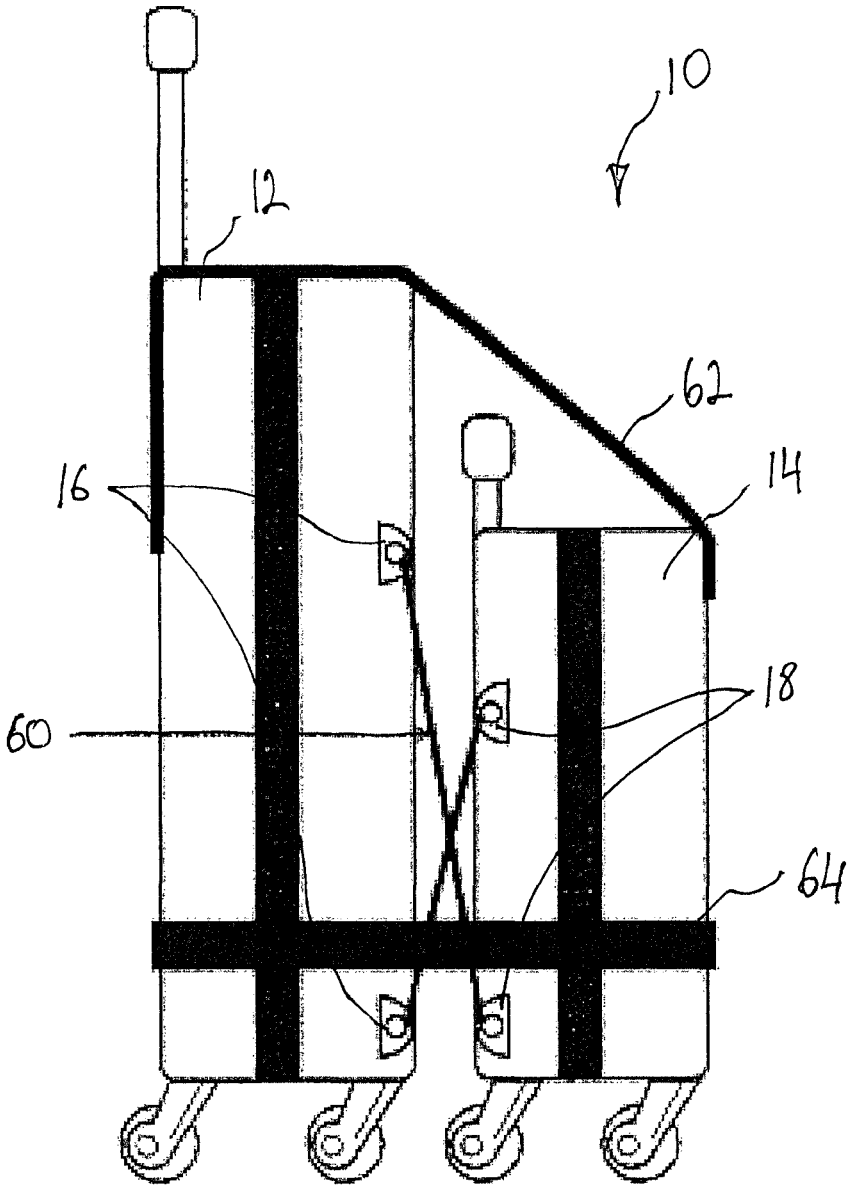
FIG. 8A is a side view of a further embodiment of the luggage system of the present invention.
Figure 8B:
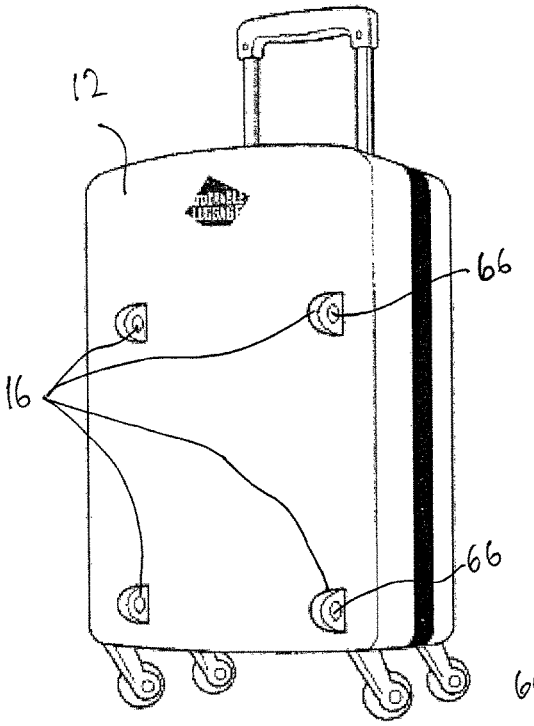
FIG. 8B is a front perspective view of a first luggage piece of the luggage system of FIG. 8A.
Figure 8C:
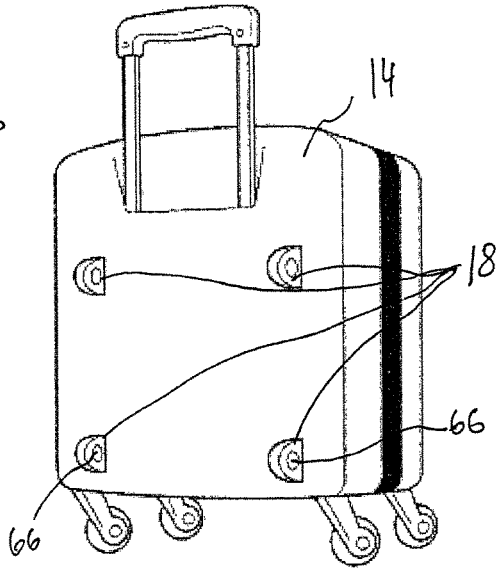
FIG. 8C is a front perspective view of a second luggage piece of the luggage system of FIG. 8A.

FIGS. 8A-8C illustrate an additional example of the attachment members of the luggage system 10 of the present invention. In this embodiment, the first piece of luggage 12 has a first plurality of female connectors 16 coupled to its front wall, and the seconds piece of luggage 14 has a second plurality of female connectors 18 coupled to its rear wall. In the embodiment shown in FIGS. 8B and 8C, each of the luggage pieces has two pairs of female connectors, each pair positioned adjacent one side of the luggage piece. The female connectors 16, 18 are made with any suitable material and are removably or permanently attached to the walls of the first and second luggage pieces by any suitable means, as described above. Each of the female connectors has an aperture 66 therein. It is understood that the shape, size and/or positioning of the female connectors shown in these figures is only exemplary and that any other suitable shape, size and/or positioning may be used in accordance with the present invention.

The luggage system further includes an elongated male connector, such as a rope 60, extended through the apertures 66 of the first and second pluralities of the female connectors 16, 18, as illustrated in FIG. 8A. The rope 60 is threaded through the female connectors 16, 18 in any suitable pattern, as long as the two pieces of luggage are secured in a movable arrangement that allows the luggage pieces to move up and down with respect to each other when the luggage system is transported on a escalator, as described above. In one exemplary embodiment, the elongated male connector 60 has a corresponding fastener, e.g. a screw-on or snap-fit fastener, at each of its ends such that the connector 60 can be unfastened and removed from the female connectors 16, 18, if it is desirable to use or transport each luggage piece separately. In other embodiments, the male connector 60 is in a form of a closed loop that is not removable from the female connectors 16, 18.

In this or any of the previously described embodiments of the luggage system, it may be desirable to provide additional attachment members to ensure a more secure attachment between the first and second luggage pieces. To achieve this, one or more additional attachment members may be provided. As shown in FIG. 8A, a belt 62 is attached to the top of the first piece of luggage 12 at its first end and is attached to the top of the second piece of luggage 14 at its second end. Additionally, a second belt 64 may be provided to attach the first and second luggage pieces closer to their bottom ends. The belts 62, 64 are preferrably removably attached to the first and second luggage pieces such that they may be removed when not needed. Any other type of additional attachment member may be used and may be positioned at a different location on the luggage pieces. The additional attachment members 62, 64 are flexible enough to allow the first and second luggage pieces to move up and down with respect to each other when transported on an escalator, as described above.

Figure 9:
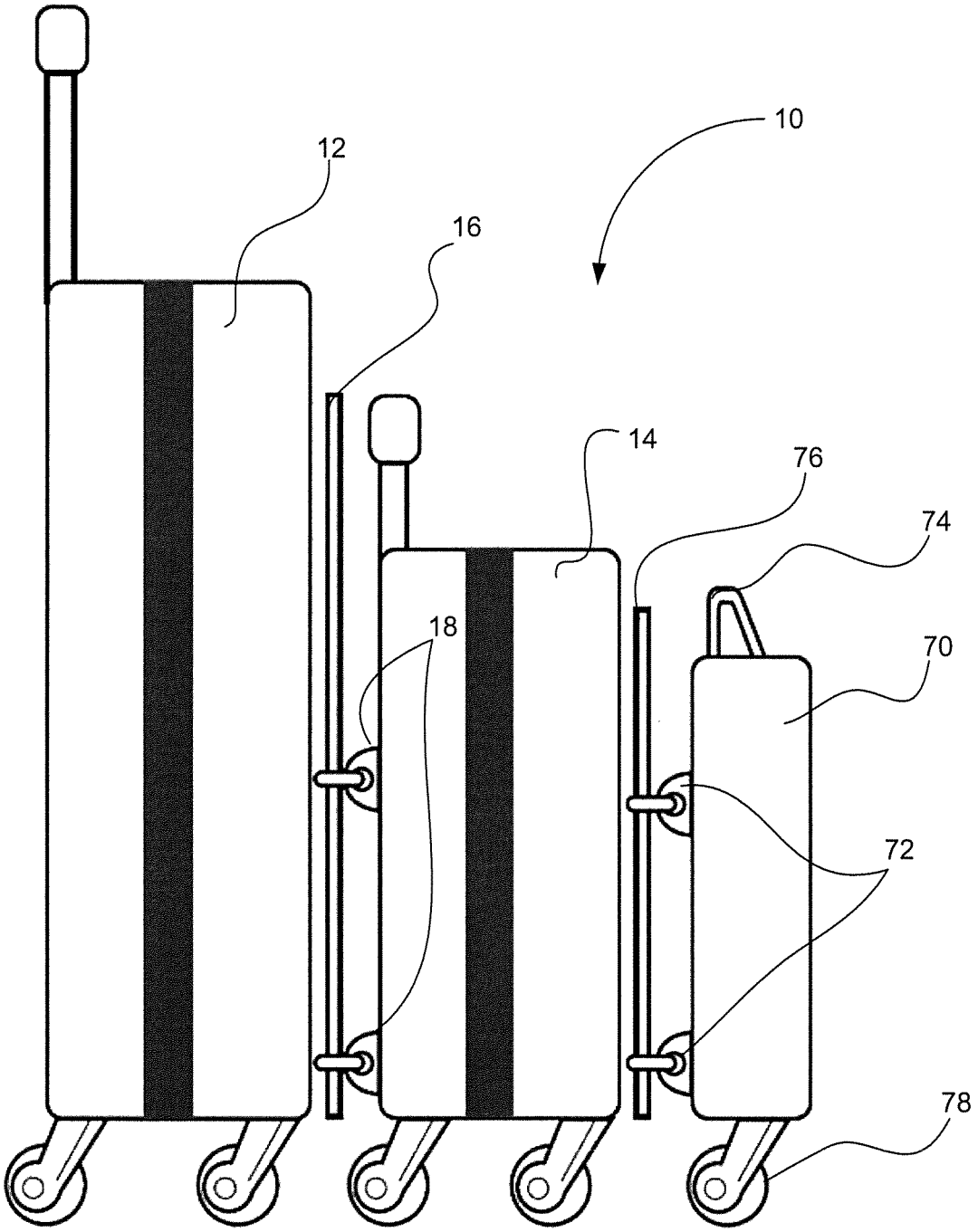
FIG. 9 is a side view of another embodiment of the luggage system in accordance with the present invention.

The luggage system 10 of the present invention may be used to transport more than two pieces of luggage. As illustrated in FIG. 9, there is a third piece of luggage 70 attached to the second piece of luggage 14. The third piece of luggage may be of any size and type and may or may not have a handle 74 and/or wheels 78. In this embodiment, the second piece of luggage 14 has a third attachment member 76 positioned on the front wall of the luggage piece and a fourth attachment member 72 positioned on a rear wall of the third piece of luggage 70. The third and fourth attachment members 76, 72 may be of any type described above. FIG. 9 illustrates the third attachment member 76 being a rod and the fourth attachment member 72 being a plurality of rings, similar to the first attachment member 16 and the second attachment member 18 respectively.

In order to attach the third piece of luggage 70 to the second piece of luggage 14, the rings 72 are slid over the rods 76. When the luggage system 10 is transported on an escalator, the third luggage piece 70 can be elevated relative the second luggage piece due to the slidable engagement between the third and fourth attachment members 76, 72. This way, each of the three luggage pieces can rest on its own step to facilitate more convenient transport of the system on the escalator.

It is understood that more than three pieces of luggage may be transported together utilizing the luggage system of the present invention. The luggage pieces may be attached in any configurations described above.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A luggage system, comprising:

a first piece of luggage, a second piece of luggage, a first attachment member positioned on the first piece of luggage, and a second attachment member positioned on the second piece of luggage and adapted to couple to the first attachment member to secure the first and second pieces of luggage together, wherein the first and second attachment members are in a movable arrangement when coupled such that the first and second pieces of luggage move relative each other, wherein one of the first and second attachment members comprises a plurality of rings and the other attachment member comprises one or more vertically positioned rods that slidably engage the plurality of rings such that the first and second pieces of luggage slide up and down with respect to each other.

2. A luggage system, comprising:

a first piece of luggage, a second piece of luggage, a first attachment member positioned on the first piece of luggage, and a second attachment member positioned on the second piece of luggage and adapted to couple to the first attachment member to secure the first and second pieces of luggage together, wherein the first and second attachment members are in a movable arrangement when coupled such that the first and second pieces of luggage move relative each other, wherein the first attachment member comprises a plurality of eyelet connectors positioned on the first piece of luggage and the second attachment member comprises a plurality of eyelet connectors positioned on the second piece of luggage, and wherein the luggage system further comprises a rope threaded through the plurality of the connectors of the first and second attachment members to secure the first and second pieces of luggage together in a movable arrangement that allows the first and second pieces of luggage to slide up and down with respect to each other.

3. A luggage system, comprising:

a first piece of luggage having a vertical axis, a second piece of luggage, a substantially rigid first attachment member coupled to the first piece of luggage, and a substantially rigid second attachment member coupled to the second piece of luggage and adapted to movably engage the first attachment member to secure the first and second pieces of luggage together, wherein the first and second attachment members are movable along a vertical axis that is parallel to the vertical axis of the first piece of luggage when engaged such that the first piece of luggage and the second piece of luggage are each adapted to rest on a separate escalator step when transported on an escalator while maintaining the engaged configuration;

wherein one of the first and second attachment members comprises a plurality of female connectors, each having an aperture therein; and wherein the other attachment member comprises one or more vertically positioned elongated male connectors coupled to one of the first and second pieces of luggage.

4. The luggage system of claim 3, wherein the first attachment member is positioned on a front wall of the first piece of luggage and the second attachment member is positioned on a rear wall of the second piece of luggage such that the first and second pieces of luggage are connected in a tandem arrangement.

5. The luggage system of claim 3, wherein the first attachment member is positioned on a side wall of the first piece of luggage and the second attachment member is positioned on a side wall of the second piece of luggage such that the first and second pieces of luggage are connected in a side by side arrangement.

6. The luggage system of claim 3, wherein at least one of the first attachment member and the second attachment member comprises a stop member that prevents movement of the other attachment member past the stop member.

7. The luggage system of claim 3, wherein at least one of the first piece of luggage and the second piece comprises two or more wheels.

8. The luggage system of claim 3, wherein at least one of the first piece of luggage and the second piece comprises a handle for transporting the luggage.

9. The luggage system of claim 3, wherein the second luggage piece further comprises a third attachment member and the system further comprises a third piece of luggage with a fourth attachment member positioned thereon and adapted to couple to the third attachment member, wherein the third and fourth attachment members are in a movable arrangement when coupled such that the second and third pieces of luggage move relative each other while engaged.

10. The luggage system of claim 3, wherein each of the plurality of female connectors has a base part coupled to one of the first and second pieces of luggage and a connector part that has the aperture therein and is movably coupled to the base part.

11. The luggage system of claim 3, wherein the one or more elongated male connectors extend through the apertures and slidably engage the plurality of female connectors such that the first and second pieces of luggage slide up and down with respect to each other.

12. The luggage system of claim 11, wherein the one or more elongated male connectors are coupled to one of the first and second pieces of luggage at an attachment point adjacent their bottom ends such that the female connectors cannot slide past the attachment point.

13. A luggage system, comprising:

a first piece of luggage having a vertical axis, a second piece of luggage, a substantially rigid first attachment member coupled to the first piece of luggage, and a substantially rigid second attachment member coupled to the second piece of luggage and adapted to movably engage the first attachment member to secure the first and second pieces of luggage together, wherein the first and second attachment members are movable along a vertical axis that is parallel to the vertical axis of the first piece of luggage when engaged such that the first piece of luggage and the second piece of luggage are each adapted to rest on a separate escalator step when transported on an escalator while maintaining the engaged configuration;

wherein one of the first and second attachment members comprises one or more vertically extending channels having an opening on one side that is opposite a side that faces a wall of one of the first and second pieces of luggage, wherein the channel opening has an inner diameter; and wherein the other attachment member comprises a plurality of protrusions, each protrusion having a base part coupled to one of the first and second pieces of luggage and a connector part having an outer diameter that is larger than the inner diameter of the channel opening.

14. The luggage system of claim 13, wherein the connector part of each of the plurality of protrusions is positioned in and slidably engages one of the vertically extending channels such that the first and second pieces of luggage slide up and down with respect to each other.

15. The luggage system of claim 14, wherein each of the vertically extending channels a top end and a bottom end, wherein the top end is open to allow for insertion of the connector part of each of the plurality of protrusions into the channel, and the bottom end is closed such that the protrusions cannot slide out of the channel.

16. A luggage system, comprising:

a first piece of luggage having a vertical axis, a second piece of luggage, a substantially rigid first attachment member coupled to the first piece of luggage, and a substantially rigid second attachment member coupled to the second piece of luggage and adapted to movably engage the first attachment member to secure the first and second pieces of luggage together, wherein the first and second attachment members are movable along a vertical axis that is parallel to the vertical axis of the first piece of luggage when engaged such that the first piece of luggage and the second piece of luggage are each adapted to rest on a separate escalator step when transported on an escalator while maintaining the engaged configuration;

wherein the first attachment member comprises a plurality of female connectors positioned on the first piece of luggage and the second attachment member comprises a plurality of female connectors positioned on the second piece of luggage, wherein each of the plurality of female connectors of the first and second attachment members has an aperture therein; and further comprising an elongated male connector extended through the apertures of the plurality of female connectors of the first and second attachment members to secure the first and second pieces of luggage together in a movable arrangement that allows the first and second pieces of luggage to slide up and down with respect to each other.

17. The luggage system of claim 16, further comprising at least one additional attachment member having a first end coupled to the first piece of luggage and a second end coupled to the second piece of luggage, wherein the at least one additional attachment member attaches the first piece of luggage to the second piece of luggage such that they are movable along the vertical axis of the first piece of luggage when attached.

18. The luggage system of claim 17, wherein the additional attachment member is removably coupled to the first and second pieces of luggage.

* * * * *